US011064771B1

(12) United States Patent
Lovato

(10) Patent No.: US 11,064,771 B1
(45) Date of Patent: Jul. 20, 2021

(54) CONNECTOR SYSTEM WITH QUICK RELEASE

(71) Applicant: Duraflex Hong Kong Limited, Hong Kong (CN)

(72) Inventor: Attilio Lovato, Turin (IT)

(73) Assignee: Duraflex Hong Kong Limited, Hong Kong (CN)

( * ) Notice: Subject to any disclaimer, the term of this patent is extended or adjusted under 35 U.S.C. 154(b) by 0 days.

(21) Appl. No.: 16/999,136

(22) Filed: Aug. 21, 2020

(51) Int. Cl.

| | |
|---|---|
| ***A44B 11/25*** | (2006.01) |
| ***A41F 1/00*** | (2006.01) |
| ***F41H 1/02*** | (2006.01) |
| *A41D 13/05* | (2006.01) |

(52) U.S. Cl.
CPC ..... *A44B 11/2596* (2013.01); *A41F 1/00* (2013.01); *F41H 1/02* (2013.01); *A41D 13/0518* (2013.01); *Y10T 24/45995* (2015.01)

(58) Field of Classification Search
CPC ..... Y10T 24/45995; Y10T 24/45194; Y10T 24/45812; A44B 11/2596
See application file for complete search history.

(56) References Cited

U.S. PATENT DOCUMENTS

| | | | | |
|---|---|---|---|---|
| 7,480,967 | B2 * | 1/2009 | Kojoori | A44B 11/006 2/322 |
| 10,051,984 | B2 | 8/2018 | Buerck et al. | |
| 10,316,887 | B2 * | 6/2019 | Iannello | F16C 11/04 |
| 2016/0037876 | A1 * | 2/2016 | Perkins | A44B 11/263 224/164 |
| 2017/0280831 | A1 * | 10/2017 | Ritchie | A44B 11/2596 |

* cited by examiner

*Primary Examiner* — Robert Sandy
*Assistant Examiner* — Michael S Lee
(74) *Attorney, Agent, or Firm* — Collard & Roe, P.C.

(57) ABSTRACT

A connector system is formed from a female portion and a male portion that slides within the female portion. The female portion has a base body, a channel, and a protrusion extending into the channel. The male portion has a base body with a locking flange extending along one longitudinal edge thereof. The spring has an aperture for receiving the protrusion when the flange is inserted into the channel. There is an actuating device connected to the spring and configured for depressing the spring. The male portion is connected to the female portion by sliding the flange into the channel until the protrusion extends through the aperture in the spring. The male portion is released from the female portion by pulling the actuating device to depress the spring until the protrusion clears the aperture, and then sliding the male portion out of the channel.

14 Claims, 10 Drawing Sheets

CONNECTOR SYSTEM WITH QUICK RELEASE

BACKGROUND OF THE INVENTION

1. Field of the Invention

This invention relates to a connector system for connecting two elements together, such as two pieces of body armor, a combat belt, backpack or any other transportable equipment that would require emergency release. In particular, the invention relates to a connector system that can be easily released by sliding the parts relative to each other.

2. The Prior Art

In the manufacture of tactical gear, it is often necessary to provide for an emergency release of two components from each other, such as components of a tactical vest used for body armor, or the connection of any other articles to the body armor. U.S. Pat. No. 10,051,984 discloses such a quick release system for use in body armor. This system comprises a C-shaped clip and a pin that slides within the cavity of the C-shaped clip. The pin has a tab that extends through the slot in the clip and is then attached to the garment and the clip is attached to another part of the garment or object. The pin and clip have cooperating detents to keep the pin from sliding out. The detents can take the form of a tab in the clip that cooperates with a recess in the pin, or the detents can be formed of fabric coverings of the ends. The drawback of this design is that it requires significant effort to disengage the detents prior to sliding the pin out of the clip.

SUMMARY OF THE INVENTION

It is therefore an object of the invention to provide a connector system that can be used to effectively connect two articles together, has a low profile and that can be released simply and easily.

This object is accomplished according to the invention by a connector system formed from a female portion and a male portion that slides within the female portion. The female portion has a base body, a channel with a longitudinal opening along one side of the base body, and a protrusion located on the base body and extending into the longitudinal channel. Preferably, the channel has a width that is greater than a width of the opening and has a rectangular cross-section, with the opening running along a center of the outer wall forming the channel. The male portion has a base body with a locking portion extending along one longitudinal edge thereof. The locking portion is formed by a flange having a width that is greater than a width of the opening in the female portion and approximating a width of the channel, and a spring extending across and distanced from the flange. The spring has an aperture for receiving the protrusion of the female portion when the flange is inserted into the channel. The spring is preferably a leaf spring that is connected at both ends to the base body and has an apex in the center of the base body above the flange. There is an actuating device connected to the spring and configured for depressing the spring. The actuating device can be a cord or anything that can connect to the spring to depress the spring toward the flange.

The male portion is connected to the female portion by sliding the flange into the channel, with the protrusion pressing the spring downward until the protrusion extends through the aperture in the spring, where the spring can move back to its relaxed position within the channel. The engagement between the protrusion and the aperture keeps the male portion from sliding any further within the channel, and effectively locks the male portion to the female portion. The male portion is released from the female portion by pulling the actuating device to depress the spring until the protrusion clears the aperture, and then sliding the male portion out of the channel.

In one embodiment, the spring has a receptacle for connecting the actuating device. The receptacle is disposed on a side of the spring facing the flange and below the aperture. In a preferred embodiment, the actuating device comprises a cord that is connected at one end to the receptacle and at another end to a toggle. The user can quickly release the male portion from the female portion by pulling the toggle in a direction perpendicular to the longitudinal extent of the spring, and then pulling the toggle in a direction more closely aligned with the longitudinal extent of the channel to slide the male portion out of the channel. Thus, only a single device is needed to release the protrusion and accomplish the sliding. This makes the release of the connector system very fast and simple to use, while still being highly secure. Preferably, the cord is threaded through holes in the receptacle to connect the cord to the receptacle. Any suitable means for connecting the cord could be used.

The male and female portions can each be provided with a slot or multiple slots in their respective base bodies for allowing attachment of the male and female portions to their respective articles Alternatively or in addition, the material of the base bodies can be made to be sewable, so that the male and female portions can be affixed to different panels of a tactical vest or applied to a backpack or other item.

To assist in the stability of the connection between the male portion and the female portion, there are extension pegs located on both longitudinal ends of the flange. The extension pegs have a shape that corresponds to a shape of a cross section of the channel, so that when the male portion is locked to the female portion, there is very little movement of the male portion within the channel.

The connector system can be made in several different sizes, depending on its use. In one embodiment, the spring extends across the entire extent of the flange. In another embodiment, the male and female portions are substantially elongated, so that the flange is substantially longer than the spring, which can be situated approximately in the longitudinal center of the flange. In one embodiment, the male and female portions each have two of the above-identified slots, arranged one after the other in the longitudinal direction.

In another embodiment, the male portion can have a tab formed thereon, extending in an opposite direction from the flange, with a tension lock type slot, which along with the slot in the base body, can form a tension-lock arrangement for threading of a strap or webbing therethrough, thus allowing for adjustability and/or eliminating the need to sew the end of the strap closed.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE EMBODIMENTS

Figure 1:
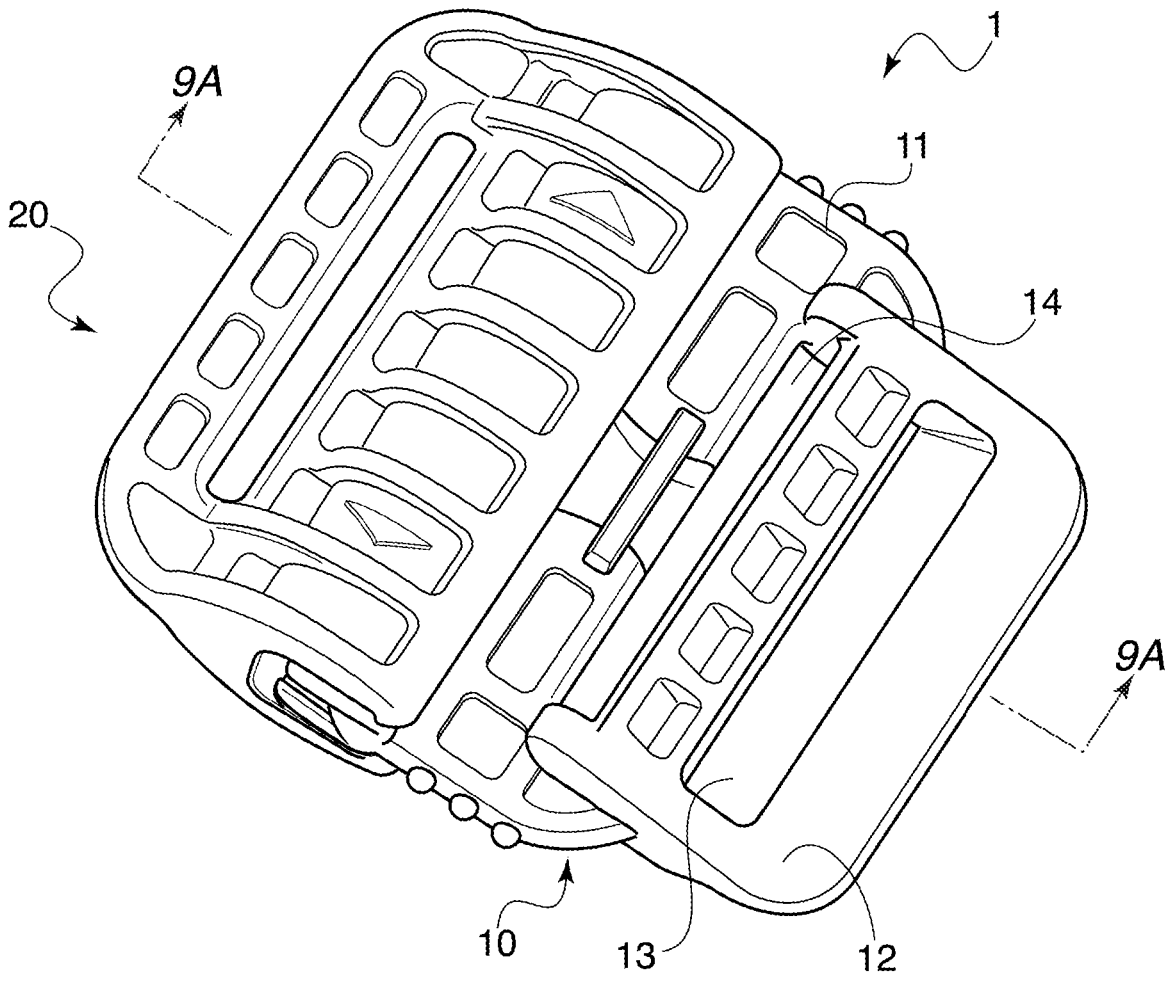
FIG. 1 shows a perspective view of the connector system according to the invention in a locked state.
Figure 2:
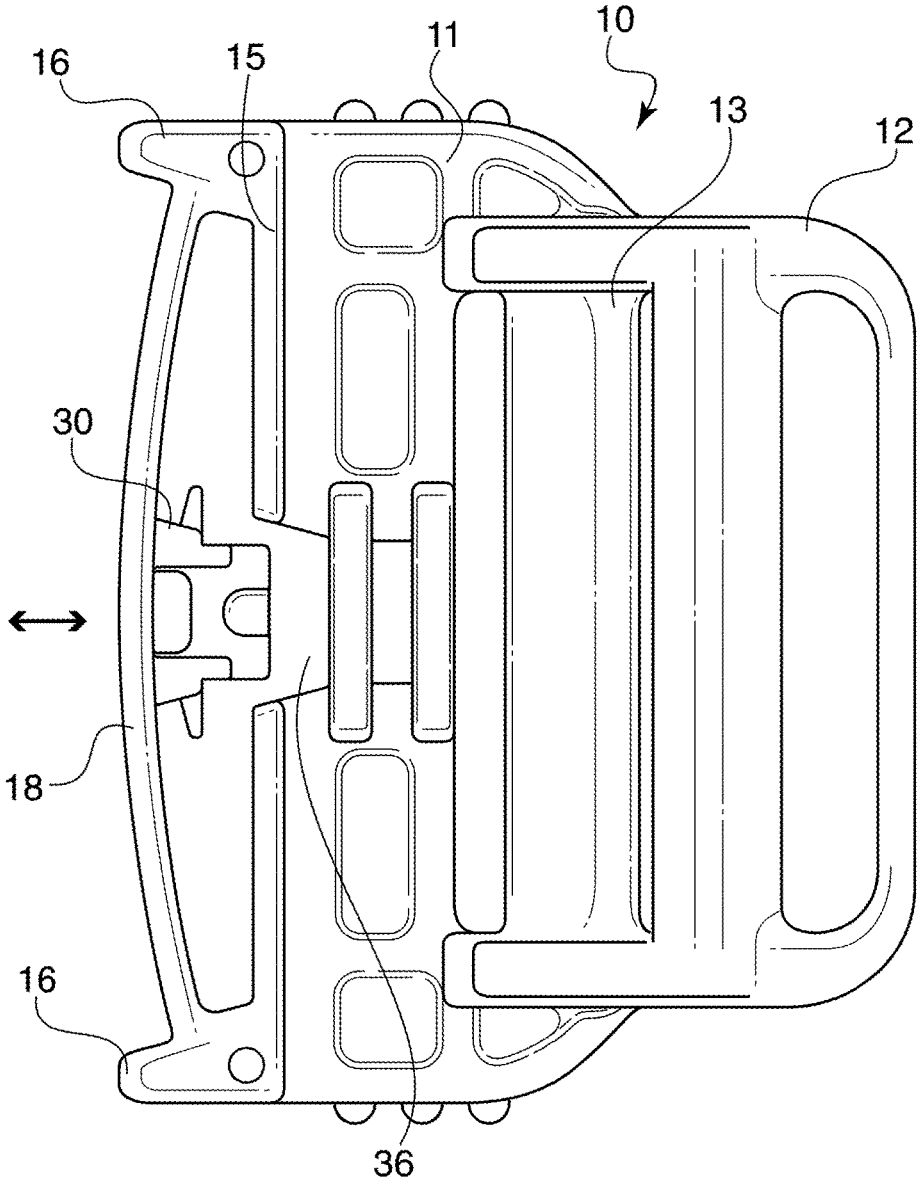
FIG. 2 shows a front view of the male portion of the system shown in FIG. 1.
Figure 3:
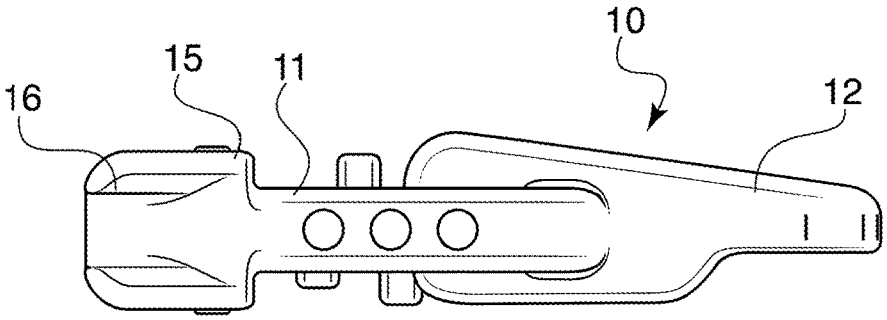
FIG. 3 shows a side view of the male portion of FIG. 2.
Figure 4:
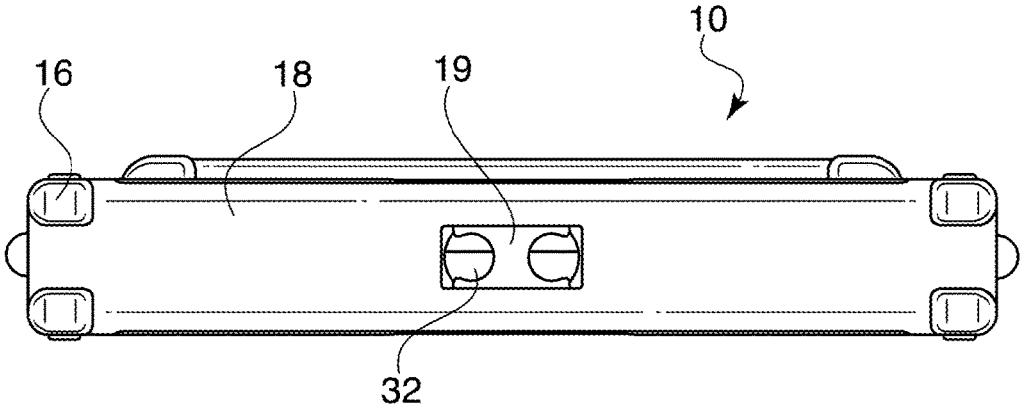
FIG. 4 shows a top view of the male portion of FIG. 2.
Figure 5:
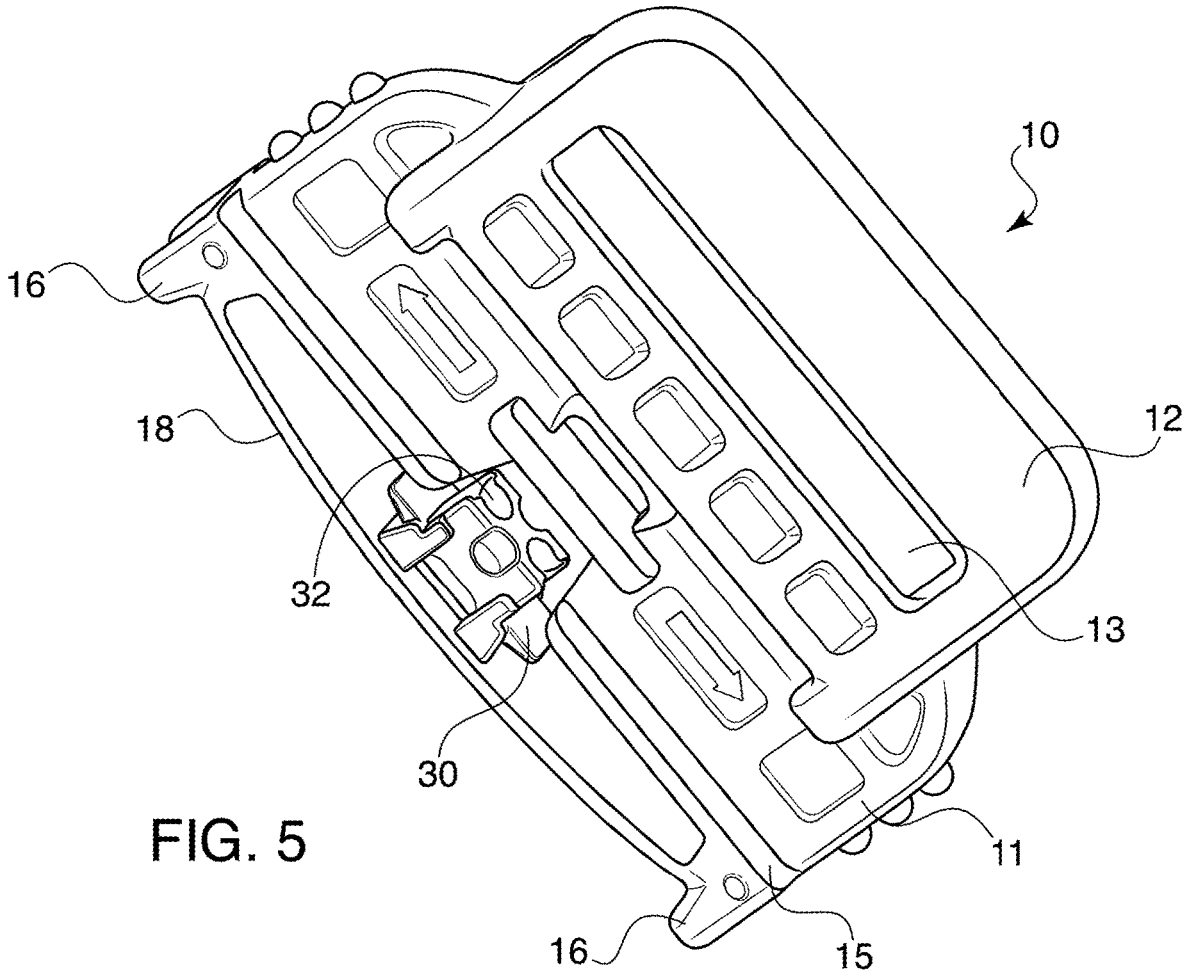
FIG. 5 show a bottom perspective view of the male portion of FIG. 2.

Referring now in detail to the drawings, FIG. 1 shows the complete connector system 1 according to the invention. Connector system 1 comprises a male portion 10 connected to a female portion 20. Male portion 10 has a base body 11 connected to a tab 12, with a tension lock slot 13, for cooperating with a slot 14 to lock a strap thereto in an adjustable manner. The operation of tension lock buckles is well known and not discussed in detail here. As shown in FIGS. 2 and 3, male portion 10 has a flange 15 that extends along one edge of base body 11. Flange 15 has a width that is substantially wider than the width of base body 11, as can be seen in FIG. 3. Flange 15 has an extension peg 16 located at each end of flange 15. Extension pegs 16 have a substantially rectangular cross-section. A leaf spring 18 is disposed along and spaced from flange 15, connected at each end to extension pegs 16. An aperture 19 is located in the center of leaf spring 18, as shown in FIG. 4. Underneath aperture 19 is a receptacle 30, which is connected to leaf spring 18 and has an interior cavity as well as two bottom openings 32, as shown in FIG. 5, which can be used to secure a cord 60, as described below.

Figure 6:
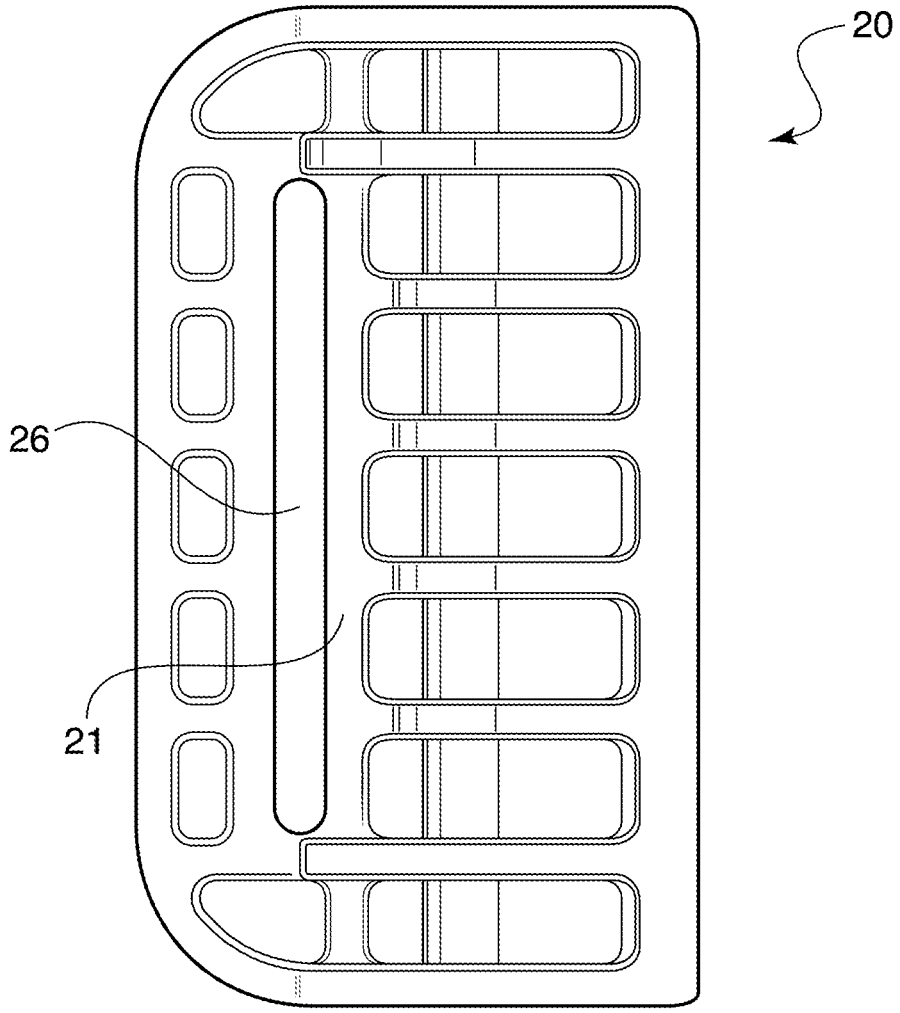
FIG. 6 shows a front view of the female portion of the system of FIG. 1.
Figure 7:
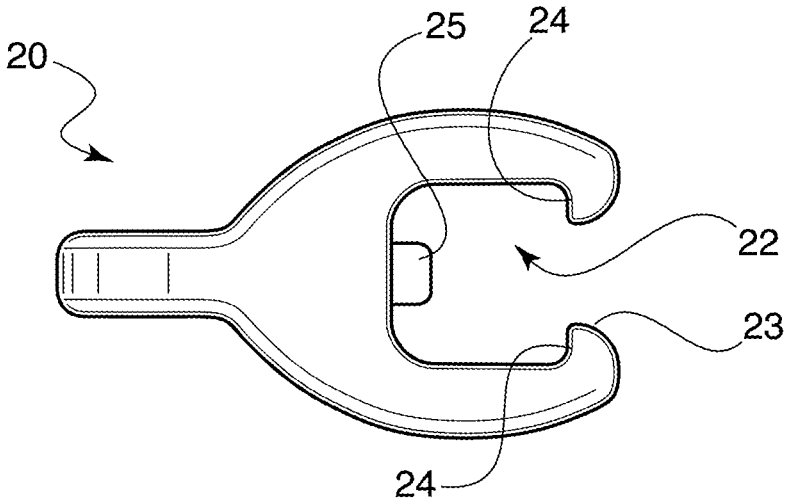
FIG. 7 shows a side view of the female portion of FIG. 6.
Figure 8:
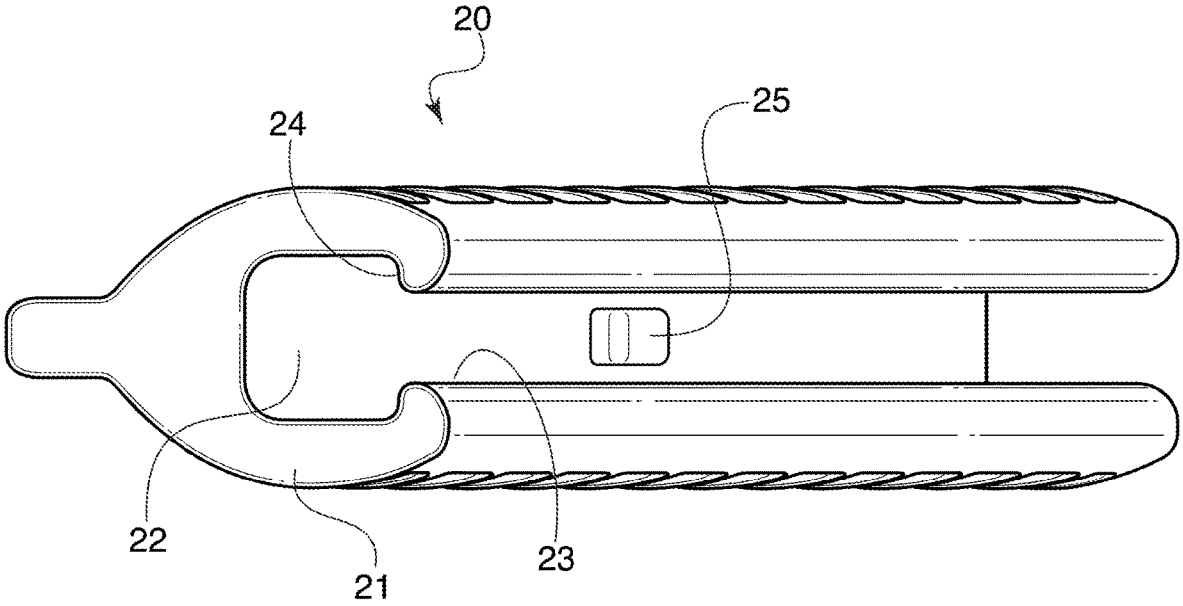
FIG. 8 shows a bottom perspective view of the female portion of FIG. 6.

FIGS. 6-8 show female portion 20, which has a base body 21, a slot 26 for receiving a strap or a connector, and a channel 22. Channel 22 is substantially square and has a longitudinal opening 23 extending along its length. Longitudinal opening 23 has a width that is less than the width of channel 22 and is located in the center of an outer-facing wall of the channel, so that two undercuts 24 are located on each side of the channel. A protrusion 25 is disposed opposite the longitudinal opening and approximately in the center of the longitudinal extent of the channel.

Figure 9:
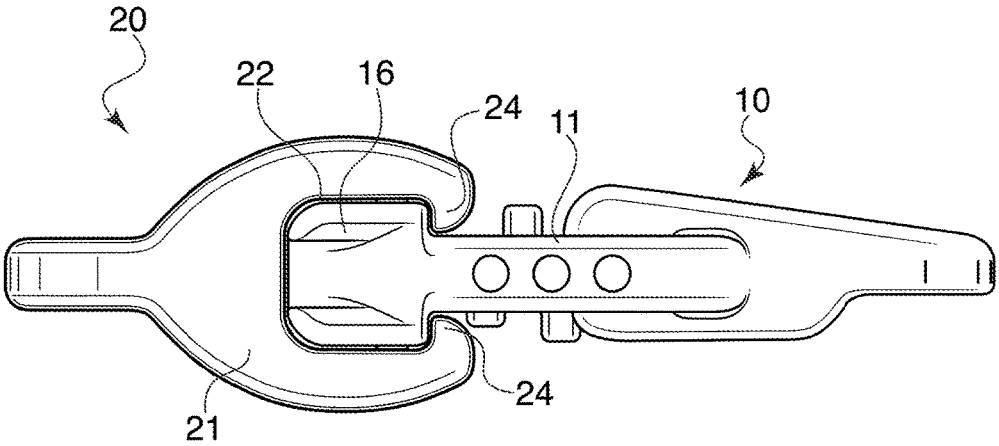
FIG. 9 shows a side view of the connector assembly shown in FIG. 1.
Figure 9A:
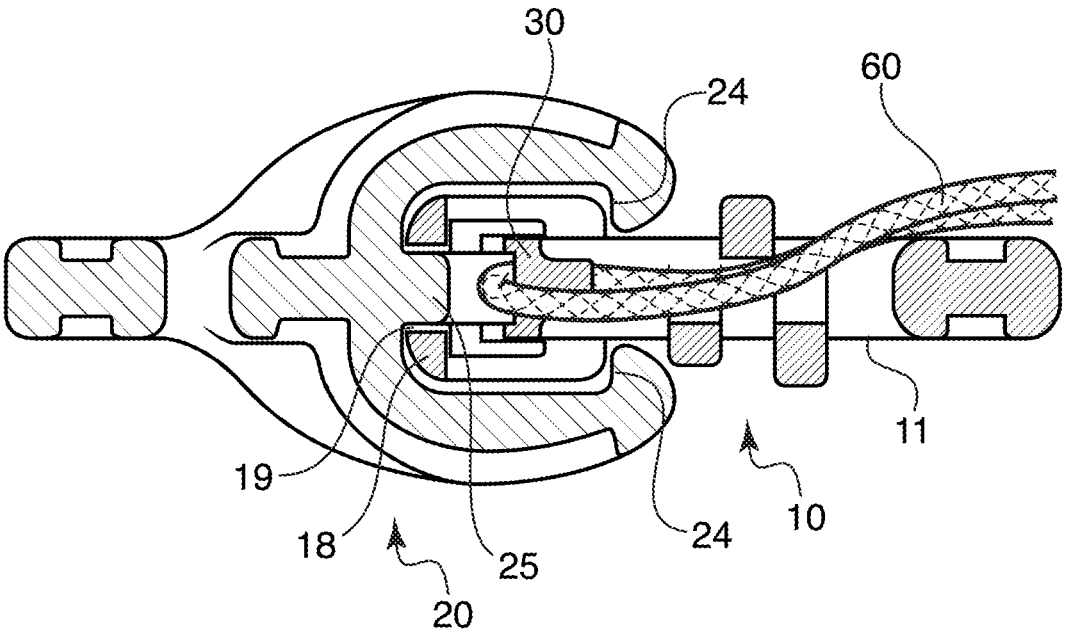
FIG. 9*a* shows a cross-section of the connector assembly along lines 9A-9A of FIG. 1.

As shown in FIGS. 9 and 9A as well as in FIG. 1, the male portion 10 and the female portion 20 are connected to each other by sliding the flange 15 of the male portion 10 into the channel 22 of female portion 20. Flange 15 has a width that is equal to the width of the channel but larger than the width of the opening 23. The undercuts 24 on either side of the opening prevent male portion 10 from pulling out of channel 22 perpendicular to the sliding direction.

Once male portion 10 is fully inserted into female portion 20, protrusion 25 extends through opening 19 in spring 18, as shown in FIG. 9A, thus preventing any further sliding between the two portions. Protrusion 25 rests within the cavity of receptacle 30 as long as the parts remain locked together. To release protrusion 25, spring 18 is pulled downward, forcing receptacle 30 into cutout 36 of base body 11 (shown in FIG. 2), until protrusion 25 clears aperture 19 in spring 18, allowing sliding between the male portion 10 and female portion 20. In order to accomplish this motion of spring 18, an actuator such as a cord 60 can be connected to receptacle 30, so that pulling the cord pulls the spring 18 downward as discussed below with respect to FIG. 16.

Figure 10:
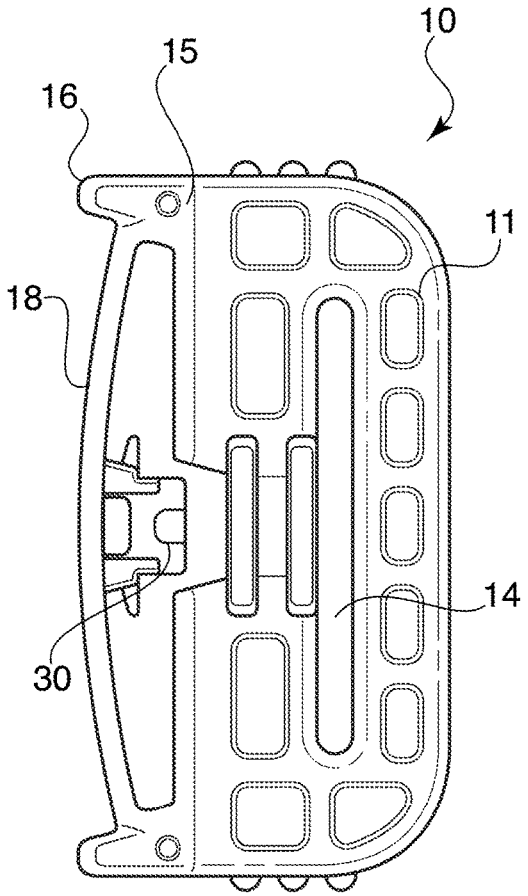
FIG. 10 shows an alternative embodiment of a male portion for use in the connector system according to the invention.
Figure 11:
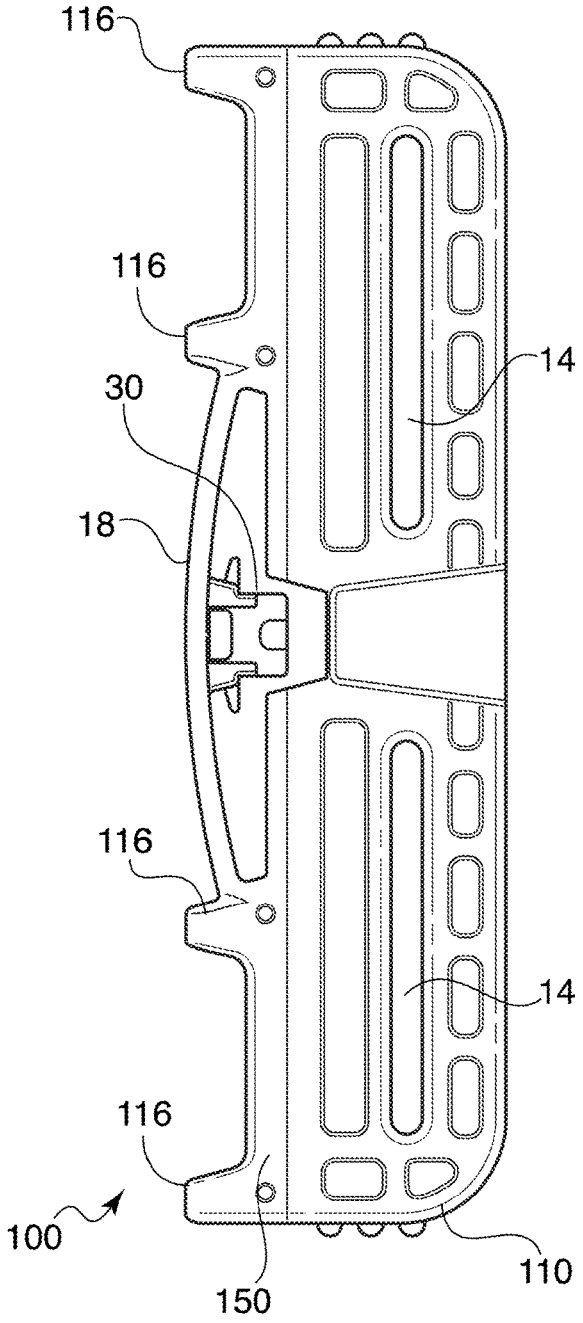
FIG. 11 shows another alternative embodiment of the male portion for use in the connector system according to the invention.
Figure 12:
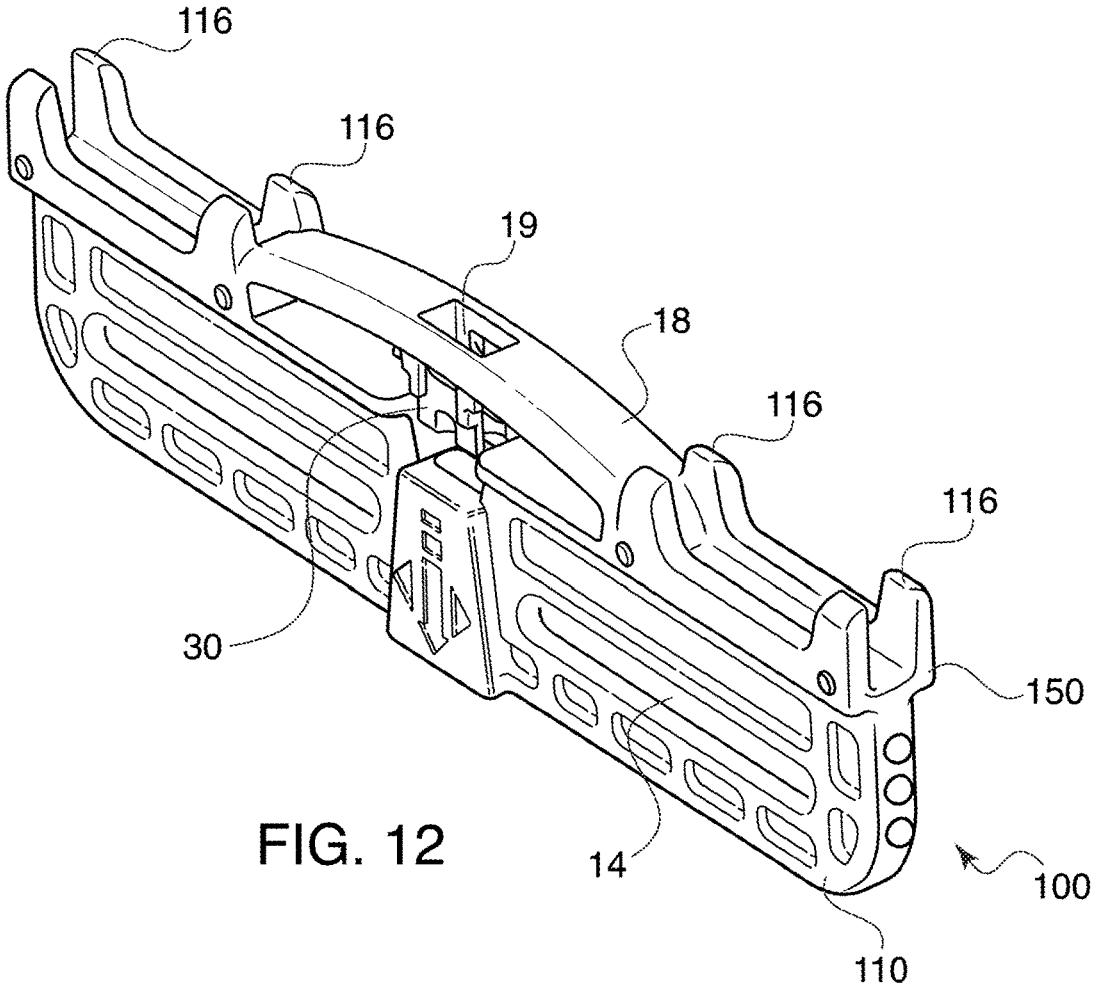
FIG. 12 shows a perspective view of the male portion of FIG. 11.
Figure 13:
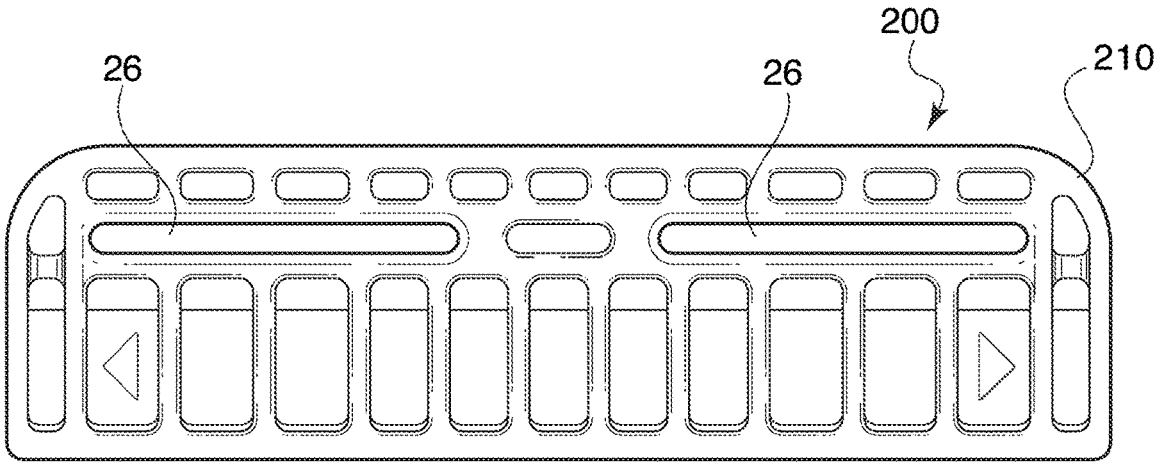
FIG. 13 shows a front view of a female portion for use with the male portion of FIG. 11.
Figure 14:
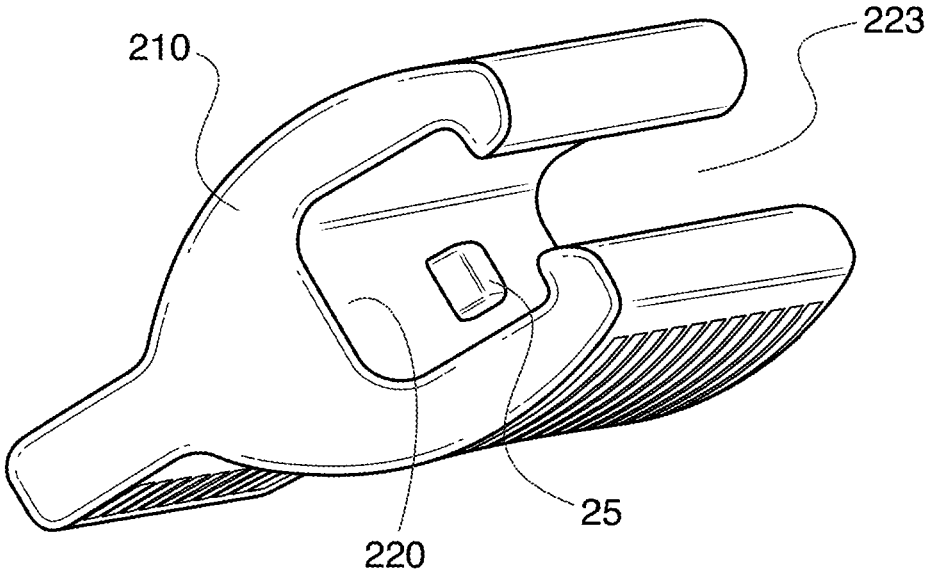
FIG. 14 shows a perspective view of the female portion of FIG. 13.

The male and female portions can be constructed of various shapes and sizes, depending on their use. In an alternative embodiment shown in FIG. 10, male portion 10 does not have tab 12, and has only the single slot 14 for connection to an article of clothing or another object. However, as shown in FIGS. 11 and 12, male portion 100 can have an elongated base body 110, which has two slots 14 arranged end-to-end. In addition, there are four pairs of extension pegs 116 arranged along flange 150, to stabilize flange 150 inside corresponding female portion 200, which is shown in FIGS. 13-14. As shown in FIG. 14, female portion 20 has a channel 220 with an elongated opening 223, similar to that of female portion 10, as well as a protrusion 25. The operation of male portion 100 and female portion 200 is substantially the same as the operation of male portion 10 and female portion 20.

Figure 15:
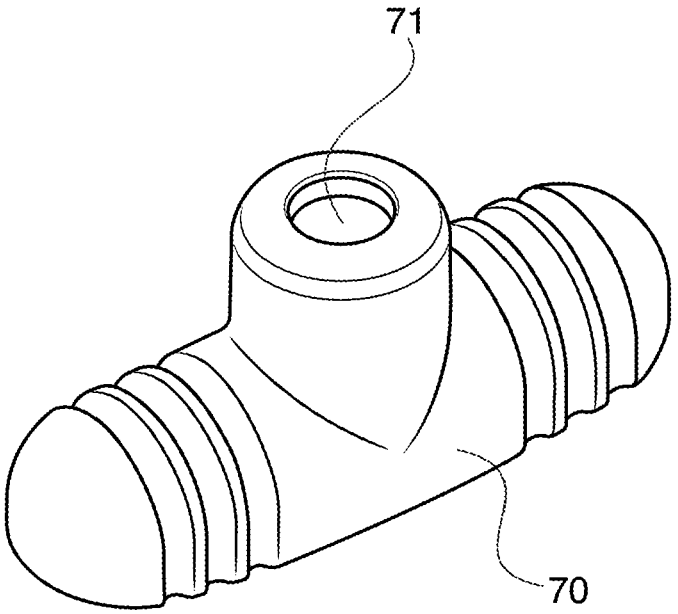
FIG. 15 shows a toggle for use in the actuating device according to the invention.
Figure 16:
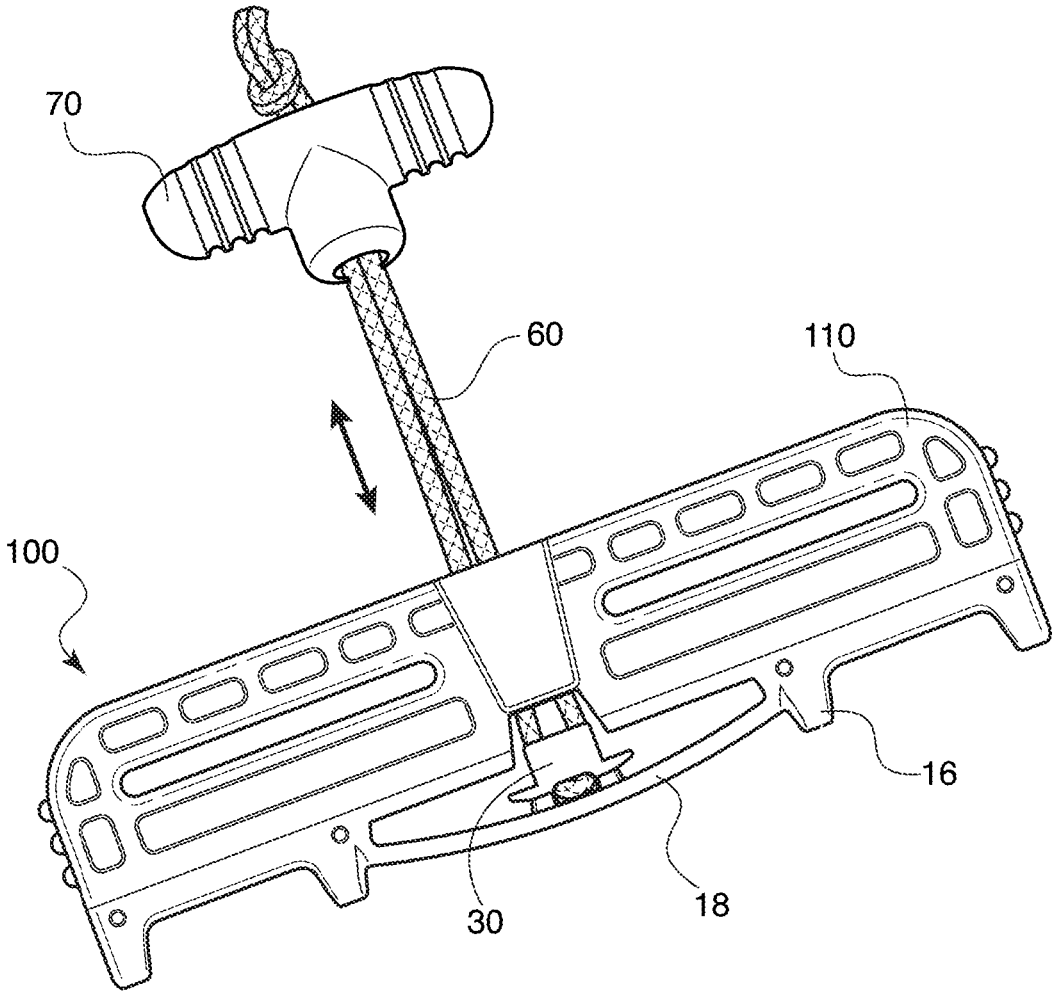
FIG. 16 shows the toggle connected via a cord to the receptacle on the male portion of FIG. 11.

FIGS. 15 and 16 relate to one embodiment of the actuating device according to the invention. As shown in FIG. 16, the actuating device can be in the form of a cord 60 that is threaded through holes 32 in receptacle 30. The free ends of cord 60 extend through a hole 71 in toggle 70, which serves as a convenient handle for pulling cord 60. Pulling cord 60 downward causes spring 18 to flex downward and allow protrusion 25 to free itself from aperture 19. Once protrusion 25 is free, the male portion 10, 100 can slide out of channel 22, 220 of female portion 20, 200 to separate the two parts of the connector system.

Accordingly, while only a few embodiments of the present invention have been shown and described, it is obvious that many changes and modifications may be made thereunto without departing from the spirit and scope of the invention.

What is claimed is:

1. A connector system comprising:

a female portion having a base body, a channel with a longitudinal opening along one side of the base body, and a protrusion located on the base body and extending into the channel, wherein the channel has a width that is greater than a width of the opening;

a male portion having a base body with a locking portion extending along one longitudinal edge, the locking portion comprising a flange having a width that is greater than a width of the opening in the female portion, a spring extending along and distanced from the flange, the spring having an aperture for receiving the protrusion; and an actuating device connected to the spring and being configured for depressing the spring;

wherein the male portion is connected to the female portion by sliding the flange into the channel until the protrusion extends through the aperture in the spring, and the male portion is released from the female portion by pulling the actuating device to depress the spring until the protrusion exits the aperture, and sliding the male portion out of the channel.

2. The connector system according to claim 1, further comprising a receptacle configured for connection with the actuating device, the receptacle being disposed on a side of the spring facing the flange.

3. The connector system according to claim 1, wherein the spring is a leaf spring.

4. The connector system according to claim 1 wherein the flange has a width equal to the width of the channel.

5. The connector system according to claim 1, further comprising a slot in the base body of the female portion or the male portion, the slot being configured for receiving webbing or a connector.

6. The connector system according to claim 1, further comprising extension pegs located on opposite sides of the flange, the extension pegs having a shape corresponding to a shape of a cross section of the channel.

7. The connector system according to claim 4, wherein the male portion has two of said slot.

8. The connector system according to claim 7, further comprising pairs of extension pegs located on opposite sides of the spring and on opposite ends of the longitudinal section.

9. The connector system according to claim 1, wherein the channel has a rectangular cross-section.

10. The connector system according to claim 2, wherein the actuating device comprises a cord.

11. The connector system according to claim 10, further comprising a toggle connected to the cord.

12. The connector system according to claim 10, wherein the cord is threaded through holes in the receptacle to connect the cord to the receptacle.

13. The connector system according to claim 5, further comprising a tension lock connector attached to the base body, the tension lock connector having an offset slot that is configured for securing a strap or a length of webbing that is threaded through the slot on the base body and the offset slot.

14. The connector system according to claim 2, wherein the base body has a cutout to accommodate the receptacle when the spring is depressed by the actuating device.

* * * * *